US005669807A

United States Patent [19]

Moreau et al.

[11] Patent Number: 5,669,807

[45] Date of Patent: Sep. 23, 1997

[54] PREFORM FOR ATTACHING A HOLDING MEMBER TO AN OPTICAL LENS, AND METHOD OF USING IT

[75] Inventors: Jacques Moreau, Savigny le Temple; Jean Perrin, Mandres les Roses, both of France

[73] Assignee: Essilor International Compagnie Generale d'Optique, Charenton le Pont, France

[21] Appl. No.: 642,359

[22] Filed: May 3, 1996

[30] Foreign Application Priority Data

May 3, 1995 [FR] France ..... 95 05278

[51] Int. Cl.[6] ..... B24B 29/00

[52] U.S. Cl. ..... 451/460; 45/42

[58] Field of Search ..... 451/390, 42, 460, 451/384, 364

[56] References Cited

U.S. PATENT DOCUMENTS

| | | | |
|---|---|---|---|
| Re. 19,015 | 12/1933 | Hill | 451/42 |
| 3,383,808 | 5/1968 | Deshayes et al. | 451/460 |
| 3,499,253 | 3/1970 | McCall | 451/460 |
| 3,512,310 | 5/1970 | Rudd et al. | 451/460 |
| 3,996,701 | 12/1976 | Ramirez et al. | 451/460 |

FOREIGN PATENT DOCUMENTS

| | | |
|---|---|---|
| 567894 | 11/1993 | European Pat. Off. . |
| 615814 | 9/1994 | European Pat. Off. . |
| 1541963 | 9/1968 | France . |

*Primary Examiner*—Robert A. Rose
*Assistant Examiner*—George Nguyen
*Attorney, Agent, or Firm*—Young & Thompson

[57] ABSTRACT

A preform for attaching a holding member to an optical lens comprises a base constrained to rotate with the optical lens to be machined by a low melting point metal coupling layer cast in situ and a superstructure capped by a drive tool. The edge of the base is inwardly offset relative to the superstructure. This enables the coupling layer to form around it a bearing surface that can be gripped by the drive tool. The preform is used to attach holding members to optical lenses, in particular ophthalmic lenses.

14 Claims, 1 Drawing Sheet

PREFORM FOR ATTACHING A HOLDING MEMBER TO AN OPTICAL LENS, AND METHOD OF USING IT

BACKGROUND OF THE INVENTION

1. Field of the Invention

The present invention concerns attaching a holding member to an optical lens so that it can be constrained to rotate with a driving tool during machining of the lens.

It is more particularly, but not necessarily exclusively, concerned with ophthalmic lenses.

2. Description of the Prior Art

To machine either face of an ophthalmic lens to its final configuration, which involves rough-grinding, finish-grinding and polishing operations, it is necessary to attach a holding member to the other face of the ophthalmic lens so that it can be held against the corresponding surfacing tool by the drive tool of an appropriate machine.

Originally the holding member was attached to the ophthalmic lens with pitch.

Subsequently it was made in situ by casting it from a low melting point metal, in practise a mixture of lead and cadmium, able to provide the necessary adhesion whilst being easy to eliminate afterwards.

Until comparatively recently the holding member has been made in one piece.

This has had many drawbacks.

Firstly, it has required a large volume of metal and consequently a relatively long casting time.

Secondly, because of the large amount of low melting point metal applied to the ophthalmic lens, the latter has been subjected to relatively high thermal shock.

Thirdly, and most importantly, because of the thickness of the mass of metal, on cooling a vacuum has frequently been produced between the ophthalmic lens and the central part of the holding member. This has made the fixing of the holding member to the ophthalmic lens less effective, with the result that the lens is attached less rigidly to the holding member, and has caused aspiration of the ophthalmic lens leading to elastic deformation of the lens. On returning to its original configuration when separated from the holding member, the ophthalmic lens has not necessarily had the desired accuracy of its machined face.

To minimize, if not eliminate, these drawbacks it has been proposed to reduce the thickness of the mass of metal used by reducing the latter to a coupling layer sandwiched between the ophthalmic lens and a prefabricated member which, by analogy with the wooden block on which ophthalmic lenses were previously placed to work them, is sometimes referred to as a block preform.

This is described in U.S. Pat. No. 5,421,770, for example.

The preform employed includes, firstly, a base with which the ophthalmic lens to be machined is constrained to rotate by means of a low melting point metal cast in situ and, secondly, a superstructure adapted to be capped by a drive tool.

This preform has the advantage that it can be used repeatedly for machining many ophthalmic lenses.

However, until now it has formed the bearing surface gripped by the drive tool, which is in practise a cylindrical bearing surface.

This inevitably results in abrasive wearing away of the preform as it is used repeatedly.

This wear is incompatible with the machining accuracy constraints that apply to ophthalmic lenses.

As in the European patent application mentioned above, the preform is usually hollow and the molten metal is fed in through an axial opening in it; the coupling layer attaching the lens is constrained to rotate with the drive tool by only a small number of studs formed in blind holes provided for this purpose on the bottom surface of the base.

The rotational interlocking of the coupling layer of metal (and thus the ophthalmic lens) with the preform is somewhat weak and the lens may not be held accurately during machining. This also reduces the accuracy of the machined surface.

Furthermore, the central feed of molten metal inevitably subjects the ophthalmic lens to non-negligible stresses in its most critical area.

A general object of the present invention is an arrangement avoiding these drawbacks.

SUMMARY OF THE INVENTION

To be more precise, in a first aspect the present invention consists in a preform for attaching a holding member to an optical lens, comprising a base adapted to be attached to and thereby constrained to rotate with the optical lens to be machined by a low melting point metal coupling layer cast in situ and a superstructure adapted to be capped by a drive tool, wherein said base has an edge that is inwardly offset relative to said superstructure.

It is then advantageously possible for the coupling layer to form around the base of the preform a bearing surface that can be gripped by the drive tool.

In another aspect, the present invention consists in a method of using the preform in which a low melting point metal coupling layer cast in situ is formed between the preform and the optical lens to attach the lens to the holding member so that it rotates with the latter and the coupling layer surrounds the edge of the base of the preform to form an annular bearing surface around it that can be gripped by a drive tool.

Thus, in accordance with the invention, the grip is transferred from the preform to the coupling layer.

This has the advantage of protecting the preform which, less subject to wear, can be used more times without compromising the surfacing conditions of the optical lenses successively machined using it.

Furthermore, the fact that the coupling layer surrounds the base of the preform has the advantage of firmly anchoring the coupling layer to the preform and the resulting rotational interlocking holds the optical lens firmly during surfacing, increasing the accuracy of the machined surface.

The coupling layer is advantageously anchored to the preform via the lateral surface of the base, which is usually larger than its bottom surface and is at a greater distance from the axis, increasing the torque at the corresponding anchorage points.

The base of the preform in accordance with the invention has at least one recess in its lateral surface to favor this anchorage, preferably a plurality of circumferentially distributed recesses.

Finally, the fact that, in accordance with the invention, the coupling layer surrounds the base of the preform is advantageously combined with peripheral feeding of the molten metal, which has the advantage of protecting the central area of the optical lens by reducing the risk of unwanted stresses being generated in it.

The features and advantages of the invention will emerge from the following description given by way of example with reference to the appended diagrammatic drawings.

DETAILED DESCRIPTION OF THE PREFERRED EMBODIMENTS

Figure 1:
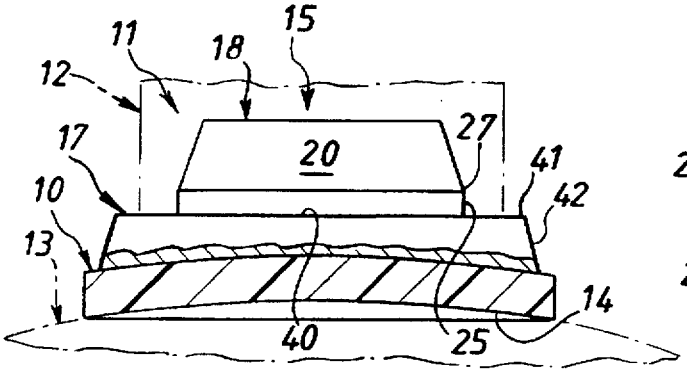
FIG. 1 is a locally cutaway side view of an optical lens fitted with a holding member using a preform of the invention.
Figure 2:
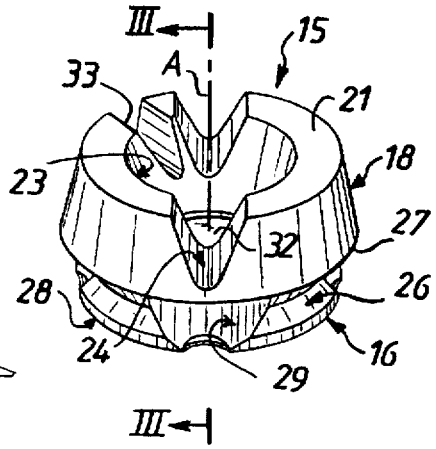
FIG. 2 is a perspective view of the preform to a different scale.

As shown diagrammatically in FIG. 1, an optical lens 10 to be machined is to be fitted with a holding member 11 adapted to enable a drive tool 12 to apply the lens 10 to a grinding wheel 13 or any other tool adapted to carry out the required surfacing operation.

FIG. 1 assumes that the face 14 of the optical lens 10 to be machined is the concave face, which is usually the case when the optical lens 10 is an ophthalmic lens.

The drive tool 12 and the grinding wheel 13 are not described here because they are well known in themselves and are not in themselves part of the present invention.

Suffice to say that at least the end of the drive tool 12 is bell-shaped and caps the holding member 11.

In a manner that is known in itself the holding member 11 incorporates a preform 15 which, as described in more detail below, has a base 16 adapted to be attached to, and thereby constrained to rotate with, the optical lens 10 to be machined by a coupling layer 17 of low melting point metal cast in situ, and a super-structure 18 that can be capped by the drive tool 12.

The preform 15 is a body of revolution about an axis A shown in chain-dotted line in the figures.

In the embodiments shown the lateral surface 20 of the superstructure 18 of the preform 15 is generally frustoconical, converging towards its top surface 21.

The top surface 21 is plane and substantially perpendicular to the axis A. The superstructure 18 has an axial recess 23 in the top surface 21 that is entirely circumscribed circumferentially by its periphery and a diametral slot 24 which is divided into two sections by the recess 23. The slot 24 is designed to cooperate with the drive tool 12.

The above provisions are well known in themselves and there is therefore no need to describe them in more detail here.

Figure 3:
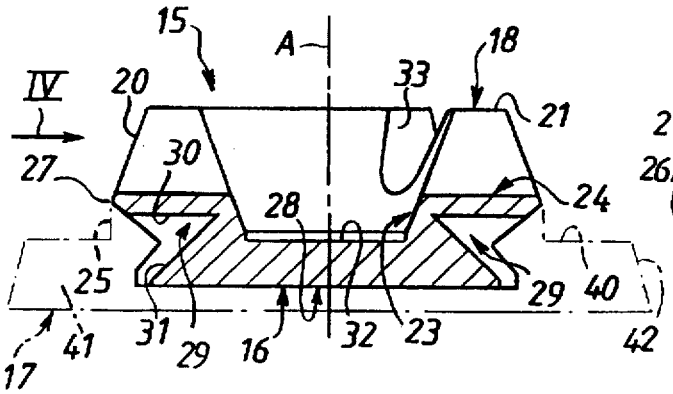
FIG. 3 is a view of the preform in axial section on the line III—III in FIG. 2 and to a larger scale.
Figure 4:
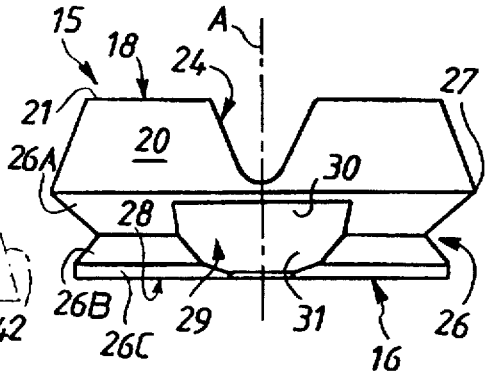
FIG. 4 is a side view of the preform as seen in the direction of the arrow IV in FIG. 3 and to the same scale as FIG. 3.

In accordance with the invention, the base 16 of the preform 15 is inwardly offset relative to its superstructure 18 to enable the coupling layer 17 to form a bearing surface 25 around it to be engaged by the drive tool 12, as shown in full line in FIG. 1 and in chain-dotted line in FIG. 3.

The bearing surface 25 is a cylindrical bearing surface with a circular cross-section concentric with the axis A.

The lateral surface 26 of the base 16 defines with the lateral surface 20 of the superstructure 18 an edge 27 from which the bearing surface 25 extends.

In the embodiment shown, the lateral surface 26 of the base 16 has, starting from the edge 27, a generally frustoconical first section 26A converging towards its bottom surface 28 and a generally frustoconical second section 26B which, unlike the first section, diverges towards the bottom surface 28.

In this embodiment the lateral surface 26 of the base 16 includes a generally cylindrical third section 26C extending peripherally around a circumference having a diameter less than that of the circumference around which the edge 27 extends. In the axial direction it extends as far as the bottom surface 28.

As a result of this configuration of the lateral surface 26 of the base 16, the base 16 is inwardly offset relative to the edge 27 that it defines with the superstructure 18 and therefore relative to the latter.

The base 16 of the preform 15 has at least one recess 29 in its lateral surface 26 to anchor the coupling layer 17 firmly and thereby achieve a rigid rotational interlock with the preform 15.

A plurality of recesses 29 are preferably provided, appropriately distributed in the circumferential direction.

In the embodiment shown there are four identical recesses 29 in a cruciform arrangement about the axis A.

In a direction parallel to the axis A, each notch 29 starts at a distance from the edge 27 defined by the base 16 and the superstructure 18 and extends as far as the bottom surface 28 of the base 16, producing a crescent-shaped notch in the edge of the bottom surface 28.

In the embodiment shown, each of the recesses 29 is in practise formed by the intersection of two surfaces, namely a plane surface 30 substantially perpendicular to the surface A at a distance from the bottom surface 28 and a curved surface 31 extending from the contour of the plane surface 30, slantwise to the axis A, and intersecting the bottom surface 28.

In the embodiment shown in FIGS. 1 through 5 the bottom surface 28 of the base 16 is flat and perpendicular to the surface A.

The recess 23 in the superstructure 18 is a blind recess.

In other words, the bottom of the recess 23 is closed by a solid wall 32.

The preform 15 of the invention preferably incorporates an angular indexing mark 33.

In the embodiments shown, this angular indexing mark 33 is a slot in the top surface 21 of the superstructure 18 angularly offset from the diametral slot 24 in the latter.

However, as an alternative to this, or additionally therewith, the angular indexing mark 33 could be formed by a localized slot in the bottom surface 28 of the base 16.

The method of using the preform 15 of the invention is as follows, for example.

Figure 5:
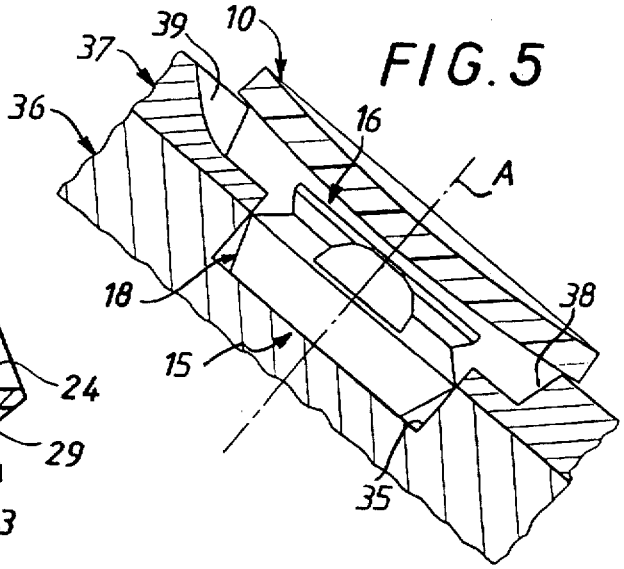
FIG. 5 is a view in axial section showing the method of using the preform of the invention.

First of all, as shown in FIG. 5, the superstructure 18 of the preform 15 is inserted in a recessed housing 35 provided for this purpose on the surface of a slightly inclined casting block 36.

A ring 37 is then attached to the casting block 36 around the base 16 of the preform 15. It has an annular imprint 38 the same shape as the coupling layer 17 to be formed, with a casting hole 39 communicating laterally with the exterior at its highest point.

Alternatively, the ring 37 could be an integral part of the casting block 36.

In either case, the optical lens 10 to be fitted with a holding member is then placed on this combination, in the direction of the axis A of the preform 15.

Arrangements familiar to the person skilled in the art are naturally used to hold the various components in position.

Finally, the imprint 38 of the ring 37 is filled via the casting hole 39 with molten low melting point metal.

In the embodiment shown the resulting coupling layer 17 has, in addition to the bearing surface 25, a shoulder 40 perpendicular to the axis A and, beyond the shoulder 40, an enlargement 41 with a generally frustoconical, lateral surface 42 diverging in the direction away from the shoulder In accordance with the invention, the coupling layer 17 formed in this way between the preform 15 and the optical lens 10 to be fitted with a holding member surrounds and peripherally encloses the base 16 of the preform 15, forming the annular bearing surface 25 around the base 16 gripped by the drive tool 12.

In the direction parallel to the axis A, the bearing surface 25 preferably extends from a point level with the superstructure 18 of the preform 15.

In other words, the bearing surface 25 preferably extends as far as the edge 27 defined by the base 16 and the superstructure 18, so that it is continuous with the latter, so to speak.

Figure 6:
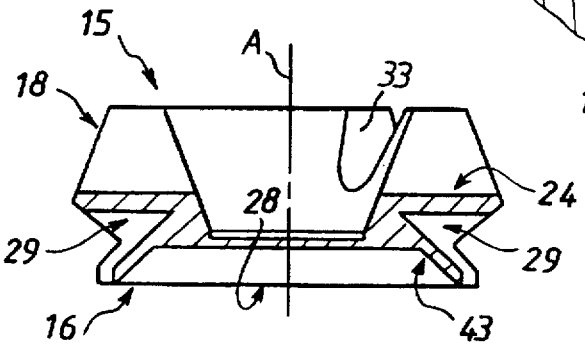
FIG. 6 is a view in axial section similar to that of FIG. 3, showing an alternative embodiment of the preform.

In the embodiment shown in FIG. 6, the base 16 of the preform 15 has a blind recess 43 in its bottom surface 28 that is entirely circumscribed annularly by its periphery.

If the optical lens 10 is highly curved, a certain saving in space advantageously results for the same quantity of metal.

Of course, the present invention is not limited to the embodiments described and shown, but encompasses any variant execution thereof, especially with regard to the number and/or the configuration of the recesses preferably provided on the lateral surface of the base of the preform.

There is claimed:

1. Preform for attaching a holding member to an optical lens, comprising a base adapted to be attached to and thereby constrained to rotate with the optical lens to be machined by means of a low melting point metal coupling layer cast in situ and a superstructure having a circumferential sidewall and adapted to be capped by a drive tool, said base having a circumferential sidewall inwardly offset relative to the sidewall of said superstructure, for contact with the metal coupling layer.

2. Preform according to claim 1 wherein said base has at least one recess on the sidewall thereof.

3. Preform according to claim 2 wherein, in a direction parallel to a rotation axis of the preform, said at least one recess extends to the bottom surface of said base and forms a notch in said bottom surface.

4. Preform according to claim 2 wherein said base includes a plurality of circumferentially distributed recesses.

5. Preform according to claim 1 wherein said base has a flat bottom surface.

6. Preform according to claim 1 wherein said base has a blind recess in a bottom surface thereof, the blind recess being entirely annularly circumscribed by the periphery thereof.

7. Preform according to claim 1 wherein said superstructure has a blind recess in a top surface thereof, the blind recess being entirely annularly circumscribed by the periphery thereof.

8. Preform according to claim 1 including an angular indexing mark.

9. Preform according to claim 8 wherein said superstructure has a diametral slot in a top surface thereof, and said angular indexing mark is defined by a slot angularly offset from said diametral slot.

10. Preform for attaching a holding member to an optical lens, said preform comprising a base adapted to be attached to and thereby constrained to rotate with the optical lens to be machined by a low melting point metal coupling layer cast in situ and a superstructure having a circumferential sidewall and adapted to be capped by a drive tool, wherein said base having a circumferential sidewall inwardly offset relative to the sidewall of said superstructure and wherein an edge is formed between said sidewall of said base and said sidewall of said superstructure, and said base sidewall has, starting from said edge, a generally frustoconical first section converging in a direction towards a bottom surface of the preform and a generally frustoconical second section diverging in a direction towards the bottom surface.

11. Preform according to claim 10 wherein said sidewall of said base has a generally cylindrical third section extending to said bottom surface.

12. Preform according to claim 10 wherein said base has at least one recess on the sidewall thereof in a direction parallel to a rotation axis of the preform, said at least one recess starting at a distance from said edge between said base and said superstructure.

13. Method of mounting an optical lens on a preform of a holding member, comprising the steps of:

(i) providing a preform comprising (a) a base adapted to be attached to and thereby constrained to rotate with the optical lens and (b) a superstructure having a circumferential sidewall and adapted to be capped by a drive tool, (c) said base having a circumferential sidewall inwardly offset relative to the sidewall of the superstructure, (ii) casting in situ a low melting point metal coupling layer around and in contact with the sidewall of the base of the preform and over a portion of the optical lens for attaching the lens to the holding member so that the lens may rotate with the holding member and so that the coupling layer surrounds the sidewall of the base of the preform and forms an annular bearing surface outwardly of the sidewall of the base adapted to be gripped by a drive tool.

14. Method according to claim 13, wherein, in the direction parallel to the rotation axis, said bearing surface on said coupling layer extends immediately from a point level with said superstructure of said preform.

* * * * *